US005297751A

United States Patent [19]

Boldrini et al.

[11] Patent Number: 5,297,751

[45] Date of Patent: * Mar. 29, 1994

[54] METHOD OF REPLACING STRIP MATERIAL ON A MANUFACTURING MACHINE

[75] Inventors: Fulvio Boldrini, Ferrara; Antonio Gamberini, Bologna, both of Italy

[73] Assignee: G.D. Societa' Per Azioni, Bologna, Italy

[ * ] Notice: The portion of the term of this patent subsequent to Jul. 14, 2009 has been disclaimed.

[21] Appl. No.: 688,293

[22] Filed: Apr. 22, 1991

[30] Foreign Application Priority Data

May 3, 1990 [IT] Italy ..... 3473 A/90

[51] Int. Cl.[5] ..... B65H 23/02; B26D 5/22

[52] U.S. Cl. ..... 242/58; 83/13; 83/102; 242/58.4

[58] Field of Search ..... 242/58, 58.1, 58.4; 156/504, 507; 83/13, 18, 23, 27, 102, 650

[56] References Cited

U.S. PATENT DOCUMENTS

| | | | |
|---|---|---|---|
| 3,844,189 | 10/1974 | Jardine | 83/102 |
| 3,925,131 | 12/1975 | Krause | 242/58.4 |
| 3,939,032 | 2/1976 | Taitel et al. | 242/58.4 |
| 4,738,739 | 4/1988 | Schoonderbeek | 156/504 |
| 4,893,534 | 1/1990 | Kobler | 83/102 |
| 5,129,294 | 7/1992 | Boldrini et al. | 83/13 |

FOREIGN PATENT DOCUMENTS

| | | | |
|---|---|---|---|
| 60-56613 | 12/1985 | Japan | 156/507 |

*Primary Examiner*—Daniel P. Stodola
*Assistant Examiner*—John Q. Nguyen
*Attorney, Agent, or Firm*—Marshall, O'Toole, Gerstein, Murray & Borun

[57] ABSTRACT

A method of replacing a first strip with a second strip on a manufacturing machine featuring an input traction device for feeding the first strip along a route defined by a first and second portion at a given angle in relation to each other; according to which method, a lead portion of the second strip is positioned along the first route portion so as to project beyond the junction between the first and second route portions, and is accelerated up to the speed of the first strip., the first strip is then cut upstream from the first route portion and the second strip is cut by a device operating in a direction coincident with that of the second route portion, so as to simultaneously cut the second strip and feed the end so formed into the traction device.

10 Claims, 2 Drawing Sheets

METHOD OF REPLACING STRIP MATERIAL ON A MANUFACTURING MACHINE

BACKGROUND OF THE INVENTION

The present invention relates to a method of replacing strip material on a manufacturing machine.

The present invention may be employed to advantage on packing machines in general and, in particular, on cigarette packing machines to which the following description refers purely by way of example.

Cigarette packing machines are known to employ, e.g. for the inner wrapping, strip foil run off a reel and cut into portions from which the inner wrapping is formed. As the operating reel is about to run out, it is usually changed with a new one by means of splicing devices, which provide for joining the end portion of the run-off strip to the lead portion of the new one, so as to make the changeover without stopping the machine.

On known splicing devices, the run-off and run-on strips are usually fed along a common route portion immediately downstream from which a standby portion of variable length is provided enabling the run-off strip to be stopped along said common route portion, for splicing the two stationary strips together One of the major drawbacks of known splicing devices of the aforementioned type is the relatively long distance covered by the strips between the reels and the user machine, and defined by said common route and standby portions, which standby portion is substantially used up at each splicing operation and, to be restored, requires that the packing machine be run at less than normal speed for a certain length of time after the strips are spliced.

Moreover, the length of said route subjects the strips to severe axial and transverse stress resulting in frequent tearing, and, in the event of the strips being torn, involves serious difficulties and relatively prolonged downtime for reassembling them.

SUMMARY OF THE INVENTION

It is an object of the present invention to provide a method of continuously switching from a run-off to a run-on strip, which method provides for splicing the strips without arresting the same, for eliminating the need for a standby portion, and for drastically reducing the distance traveled by the strips between the reels and user machine.

According to the present invention, there is provided a method of replacing strip material on a manufacturing machine, in particular, for replacing a first run-off strip with a second run-on strip on a manufacturing machine featuring an input traction device for feeding said first strip to said machine along a given route; characterised by the fact that said route comprises a first and second portion at a given angle in relation to each other and having a connecting portion located at the input of said traction device; said method comprising stages consisting in positioning a lead portion of said second strip along said first route portion, in such a manner that said lead portion projects beyond said connecting portion in the direction of said first route portion; accelerating said second strip up to the speed of said first strip along said first route portion; cutting said first strip upstream from said traction device; cutting said second strip along said first route portion via mobile cutting means; and, via mobile guide means, guiding the end so formed of said second strip into said traction device.

Said mobile cutting and guide means are preferably integral with each other and are moved simultaneously into their respective cutting and guide positions.

According to a preferred embodiment of the invention as described above, said mobile cutting and guide means are defined respectively by a cutting edge and by the curved surface of a plate moved, by actuating means, to and from said operating positions in a direction coincident with that of said second route portion, so as to cut said second strip and insert the end so formed into said traction device in a single operation.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
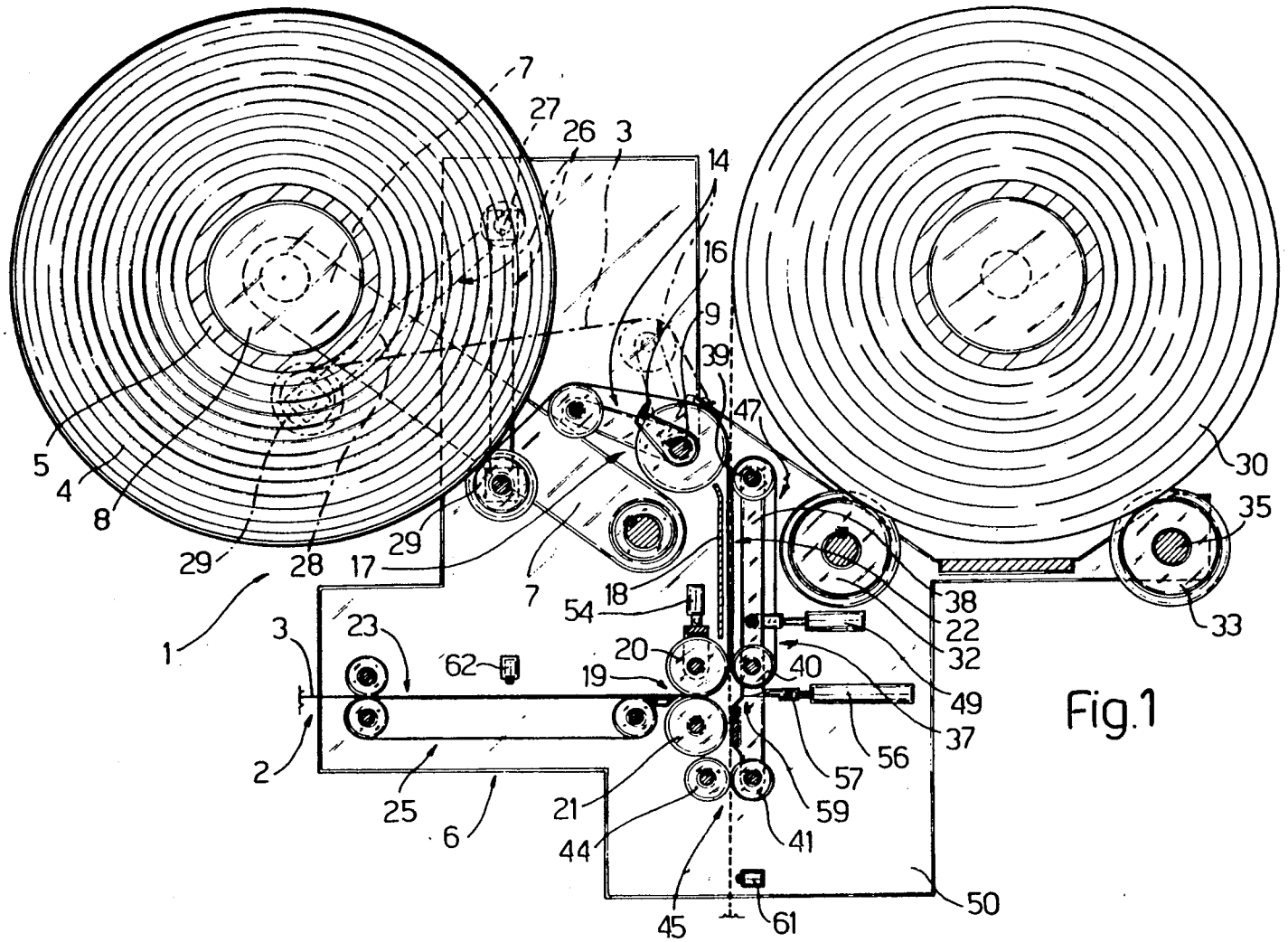
FIG. 1 shows a schematic view of a strip feed device implementing the method according to the present invention.

Number 1 in FIG. 1 indicates a device for supplying a packing machine 2 with a strip 3 of foil run off a reel 4 having a center core 5 supported in rotary manner (counterclockwise in FIG. 1) by an arm 7 on bed 6. Arm 7 pivots at the bottom end on bed 6 and is fitted, on the top end, with a cylindrical pin 8 fitted inside core 5. As shown more clearly in FIG. 2, bed 6 is fitted through with a shaft 9 oscillated about its axis by actuating means not shown. Shaft 9 supports in idle manner a roller 10 and a lever 11 extending radially outwards from shaft 9 and fitted on its free end with a pin 12 parallel to shaft 9 and supporting a second roller 13 substantially coplanar with roller 10. The assembly consisting of roller 13 and lever 11 constitutes a tensioning device 14 connected to bed 6 by elastic means (not shown) for turning lever 11 clockwise about shaft 9. Shaft 9 is fitted with a radial rod 15, one end of which is fitted with a blade 16 parallel to shaft 9. Roller 10 and tensioning device 14 constitute a deflecting device 17 about which strip 3 is fed prior to engaging a guide 18. Guide 18 is supported in fixed manner on bed 6, and extends vertically downwards to a traction unit 19 constituting the input unit of machine 2 and comprising two rollers 20 and 21, normally two embossing rollers, powered to turn in opposite directions and arranged vertically one on top of the other.

Rollers 20 and 21 define the route by which strip 3 is fed on to machine 2, said route comprising, commencing from deflecting roller 10, a first downward portion 22 extending along guide 18, and a second input portion 23 on to machine 2. Said route portions 22 and 23 are arranged at an angle and connected by a connecting portion defined along an outer peripheral portion of roller 20. In particular, portion 22 terminates along the line of tangency between rollers 20 and 21.

In the example shown, said angle is substantially a right angle covered by strip 3 winding about roller 20 and between rollers 20 and 21, by which it is fed in a substantially horizontal direction perpendicular to guide 18. Obviously, instead of being arranged vertically one on top of the other, rollers 20 and 21 may be aligned differently for forming an angle of more or less than 90° but not too close to 180°. Strip 3 is fed by unit 19 on to a substantially horizontal plate 24 connecting roller 21 to a horizontal suction conveyor belt 25. The function of plate 24, which may even be dispensed with, is to prevent strip 3 from being fed downwards about roller 21 instead of horizontally on to conveyor 25, which forms part of packing machine 2.

Reel 4 is provided with a device 26 for detecting the amount of strip 3 remaining, at all times, on reel 4. Detecting device 26 comprises a shaft 27 mounted for rotation through bed 6 and fitted with a lever 28, the free end of which supports a rotary feeler roller 29 maintained contacting the periphery of reel 4 by elastic means (not shown) located between lever 28 and bed 6. On reaching an angular position wherein roller 29 substantially contacts the outer periphery of core 5, shaft 27, via a control (not shown) normally consisting of a microswitch, activates the actuating device (not shown) of shaft 9, which turns with rod 15 clockwise about its axis so as to cut strip 3 by means of blade 16.

A second reel 30 for a second strip 31 identical to strip 3 is set up on bed 6 beside reel 4, and supported in rotary manner on a saddle defined by two rollers 32 and 33, the first of which is a powered roller fitted on to a drive shaft 34, while the second is mounted in idle manner on a pin 35. Roller 32 presents two outer flanges 36 (only one of which is shown) for transversely guiding reel 30 as it turns (counterclockwise in FIG. 1) in relation to bed 6.

Along route portion 22 of strip 3, a device 37 is provided for reeling off and guiding strip 31. Device 37 comprises a frame 38 arranged parallel to guide 18, on the opposite side of route portion 22 in relation to rollers 20 and 21, and supporting three rollers 39, 40 and 41, the first of which, located at the top substantially facing roller 10, is mounted in idle manner on a pin 42 on frame 38; the second of which, located in the middle substantially facing roller 20, is fitted on a drive shaft 43; and the third of which is arranged facing and tangent to a roller 44 arranged vertically beneath rollers 20 and 21 and with which roller 41 constitutes a powered tensioning unit 45.

Together with a looped belt 46, rollers 39 and 40 define a conveyor 47 parallel to guide 18 and extending along route portion 22 of strip 3, while frame 38 defines, between rollers 40 and 41, a guide portion 48 extending along an extension of route portion 22.

By means of an actuator 49, frame 38 is moved, in relation to bed 6 and in a direction perpendicular to route portion 22 and core 5, between a forward position, wherein conveyor 47 and roller 41 substantially contact roller 20 and roller 44 respectively, and a withdrawn position wherein conveyor 47 and roller 41 are located a given distance from roller 20 and roller 44 respectively.

Frame 38 and rollers 20, 21 and 44 are mounted on a plate 50 extending downwards from bed 6. In particular, roller 20, which is driven by roller 21 via gears 51 and 52, presents a shaft 53 connected to an actuating device 54 which, in certain cases, may be dispensed with, and provides for moving roller 20 transversely upwards and away from roller 21. In particular, actuator 54 provides for moving the axis of shaft 53 along a plane parallel to route portion 22 and through the axis of a shaft 21*a* fitted with roller 21.

Rod 55 of an actuator 56 is assembled facing frame 38, and is moved by actuator 56 in a direction perfectly aligned and coincident with route portion 23 of strip 3. The free end of rod 55 is fitted with a plate 57 defined at the top by a cylindrical surface 58 having substantially the same radius as the outer surface of roller 20 and terminating, on the side facing unit 19, in a cutting edge arranged transversely in relation to the axis of strip 3 and constituting a cutting blade 59. Blade 59 is moved by actuator 56 between a withdrawn position, wherein it is positioned on the opposite side of guide portion 48 in relation to traction unit 19, and a forward position wherein surface 58 of plate 57 substantially contacts the outer surface of roller 20 with blade 59 between rollers 20 and 21, or, if roller 20 can be moved away from roller 21, wherein plate 57 is located slightly beyond the above position, with blade 59 beyond the generating line of roller 21 tangent to roller 20.

Under normal operating conditions, strip 3 is reeled off by traction unit 19, driven by the main motor (not shown) on packing machine 2, and is fed about rollers 10, 12 and 20 and along route portion 23 over conveyor 25 on to machine 2.

Under normal operating conditions, a standby reel 30 is loaded in known manner on to rollers 32 and 33, and roller 32 is activated for reeling off part of strip 31, the lead portion 60 of which is fed downwards between conveyor 47, in the withdrawn position, and rollers 10 and 20, so as to engage tensioning unit 45. Once past tensioning unit 45, lead portion 60 of strip 31 is detected by a sensor 61, which stops roller 32 and operates actuator 49 for bringing conveyor 47 substantially (but not completely) into contact with roller 20, and roller 41 into close contact with roller 44 so as to grip strip 31.

As strip 3 is run off reel 4, feeler roller 29 gradually works its way towards core 5 until, when only a few turns of strip 3 are left on core 5, shaft 27 activates roller 32, conveyor 47 and tensioning unit 45, so as to gradually accelerate strip 31 and feed it along route portion 22 at the same speed as strip 3. At this point, sensor means (no shown), preferably provided on tensioning unit 45, operate the actuating means (not shown) of blade 16 so as to cut the last of strip 3.

A point to note in connection with the above is that the surface speed of rollers 41 and 44 of tensioning unit 45 is preferably greater than the speed at which strip 31 is run off reel 30 by roller 32. This provides for perfectly tensioning strip 31 in front of plate 57, which is moved by actuator 56 from the withdrawn to the forward operating position, so as to cut strip 31 via blade 59 along downward route portion 22 and, at the same time, feed the lead end of strip 31, via guide surface 58, between rollers 20 and 21 of traction unit 19 and so feed strip 31 on to machine 2 at the required speed and together with the trailing portion of strip 3.

Figure 2:
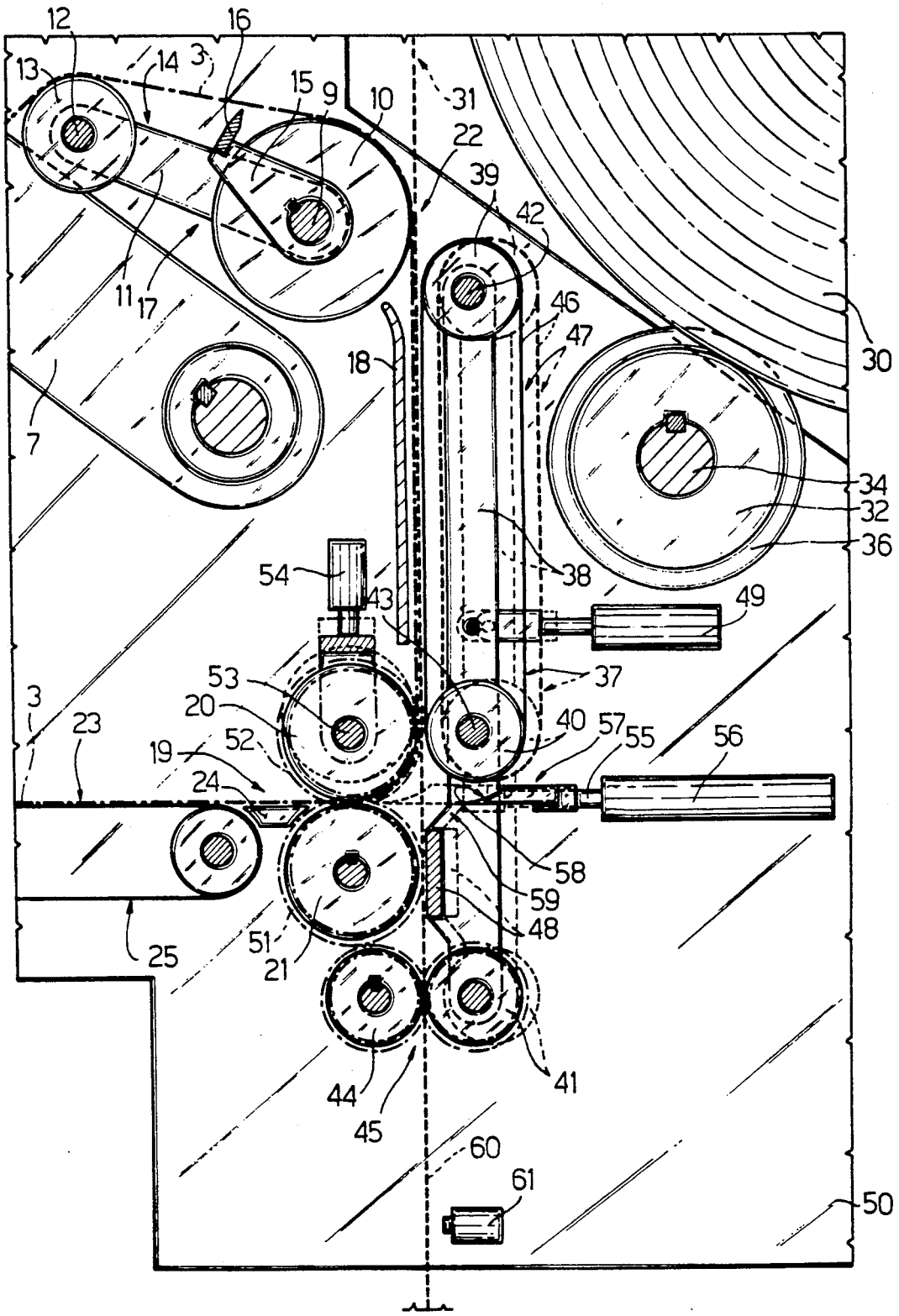
FIG. 2 shows a larger-scale view of a detail in FIG. 1 in two operating positions.

In connection with the above, and as shown in FIG. 2, it should be pointed out that, when shaft 53 is fixed and actuator 54 for raising roller 20 is dispensed with, the position of plate 57 shown by the dotted line in FIG. 2 corresponds to said forward operating position, wherein guide surface 58 is arranged facing the peripheral portion of roller 20 connecting route portions 22 and 23. Alternatively, when provision is made for raising shaft 53 by actuator 54, rollers 20 and 21 are separated just before operating actuator 56, and the forward operating position of plate 57 is that in which surface 58 of plate 57 substantially contacts the outer periphery of roller 20.

The passage of said trailing portion of strip 3 along conveyor 25 is detected by a sensor 62, which de-activates roller 32, conveyor 47 and tensioning unit 45, operates actuator 49 for restoring frame 38 to the withdrawn position, and activates a known device (not shown) for disposing of said trailing portion of strip 3.

By virtue of the angle formed by route portions 22 and 23 of strip 3 as it is fed on to machine 2, the cutting device consisting of plate 57 operating in line with route portion 23 on to machine 2 therefore clearly provides for simultaneously cutting strip 31 and feeding the lead end of the same along route portion 23 on to machine 2.

We claim:

1. A method of replacing strip material on a manufacturing machine such as for replacing a first run-off strip (3) with a second run-off strip (31) on a manufacturing machine (2) having a strip traction device (19), the method comprising:

feeding a first strip (3) to said machine (2) along a given route comprising a first portion (22) and a second portion (23) at an angle to the first portion;

the second portion (23) extending through said traction device (19);

positioning a lead portion of the second strip (31) along and beyond the first route portion (22);

accelerating the second strip (31) up to the speed of the first strip (3) along the first route portion (22);

cutting the first strip (3) along the first route portion (22) thereby forming a first strip trailing portion in the first route portion located adjacent the second strip portion in the first route portion;

engaging the second strip (31) along the first route portion (22) by cutting and guide means (57); and reciprocating said cutting and guide means (57) to and from an operating position to cut the second strip and, at the same time, to guide a cut free end so formed of the second strip (31) into engagement with said traction device (19) together with the trailing portion of the first strip.

2. A method according to claim 1 wherein:

the cutting and guide means (57) are moved, when reciprocating, toward said operating position in a direction coincident with that of the second route portion (23) so as to cut the second strip (31) at a junction between the first and second route portions (22, 23), and simultaneously feed the so-formed end of the second strip (31) into said traction device (19).

3. A method according to claim 2 wherein:

the first route portion (22) extends parallel with a plane defined by two parallel axes of two traction rollers (20, 21) tangent to each other along a line;

the second route portion (23) intersecting said line and blending with the first route portion (22) about an outer surface portion of a first one (20) of said rollers (20, 21) in the direction of travel of said first strip along said first route portion; and the cutting and guide means (57) being moved, when reciprocating, through said line of tangency.

4. A method according to claim 3 comprising:

separating said two rollers (20, 21) as said cutting and guide means (57) are moved into said operating position.

5. A method according to claim 3 comprising:

tensioning the second strip (31) along the first route portion (22) prior to cutting the second strip (31).

6. A method according to claim 5 wherein:

the second strip (31) is tensioned by applying tension to a portion thereof arranged along an extension of the first route portion (22) extending beyond a junction between the first and second route portions.

7. A method according to claim 2 comprising:

tensioning the second strip (31) along the first route portion (22) prior to cutting the second strip (31).

8. A method according to claim 7 wherein:

the second strip (31) is tensioned by applying tension to a portion thereof arranged along an extension of the first route portion (22) extending beyond a junction between the first and second route portions.

9. A method according to claim 1 comprising:

tensioning the second strip (31) along the first route portion (22) prior to cutting the second strip (31).

10. A method according to claim 9 wherein:

the second strip (31) is tensioned by applying tension to a portion thereof arranged along an extension of the first route portion (22) extending beyond a junction between the first and second route portions.

* * * * *